United States Patent [19]

Hirschorn

[11] 4,316,522

[45] Feb. 23, 1982

[54] ACOUSTIC FILTER SILENCER

[75] Inventor: Martin Hirschorn, New York, N.Y.

[73] Assignee: Industrial Acoustics Company, Inc., Bronx, N.Y.

[21] Appl. No.: 91,990

[22] Filed: Nov. 7, 1979

[51] Int. Cl.[3] ..... E04F 17/04; F01N 1/10; F02M 35/12

[52] U.S. Cl. ..... 181/224; 181/229; 181/252; 181/257

[58] Field of Search ..... 98/43 R; 181/212, 214, 181/222, 224, 229, 225, 252, 256–258; 55/276, DIG. 28

[56] References Cited

U.S. PATENT DOCUMENTS

| | | | |
|---|---|---|---|
| 2,299,112 | 10/1942 | Schilling | 181/224 |
| 2,916,101 | 12/1959 | Naman | 181/224 |
| 3,033,307 | 5/1962 | Sanders et al. | 181/224 |
| 3,195,679 | 7/1965 | Duda et al. | 181/222 |
| 3,435,911 | 4/1969 | Greenheck | 181/224 |
| 3,511,336 | 5/1970 | Rink et al. | 181/224 |

FOREIGN PATENT DOCUMENTS

| | | | |
|---|---|---|---|
| 590873 | 4/1959 | Italy | 181/257 |
| 746949 | 3/1956 | United Kingdom | 181/224 |

OTHER PUBLICATIONS

Ver et al., "Design of a Toned Muffler for Large Induced-Draft Fans", Inter-noise 78, May 8, 1978, pp. 309-316.

*Primary Examiner*—L. T. Hix

*Assistant Examiner*—Thomas H. Tarcza

*Attorney, Agent, or Firm*—Morgan, Finnegan, Pine, Foley & Lee

[57] ABSTRACT

A sound silencer for insertion in a duct having a fluid medium flowing therethrough includes an outer housing having an open entry end, an open exit end, a base portion, a roof portion, and a pair of opposed sidewalls. The silencer further includes a plurality of spaced apart sound attenuating members which are disposed upright within the housing. The sound attenuating members are arranged in columns and rows, each of the sound attenuating members being disposed substantially normal to the housing base and extending from the base to the housing roof such that the sound attenuating members define a first plurality of through passageways substantially parallel to the direction of the main flow of the fluid medium and extending from the entry end of the housing to the exit end thereof and a second plurality of through passageways disposed substantially perpendicular to the direction of the main flow of the fluid medium and extending from one of the housing side walls to the other side wall. Each of the sound attenuating members may be substantially filled with a sound absorptive material, with each face of the sound attenuating members being acoustically transparent or, alternatively opaque. Thus, the silencer combines dissipative, i.e., sound absorptive components with the overall reactive configuration of the silencer so as to effectively attenuate noise in a wide range of high and low frequencies.

15 Claims, 14 Drawing Figures

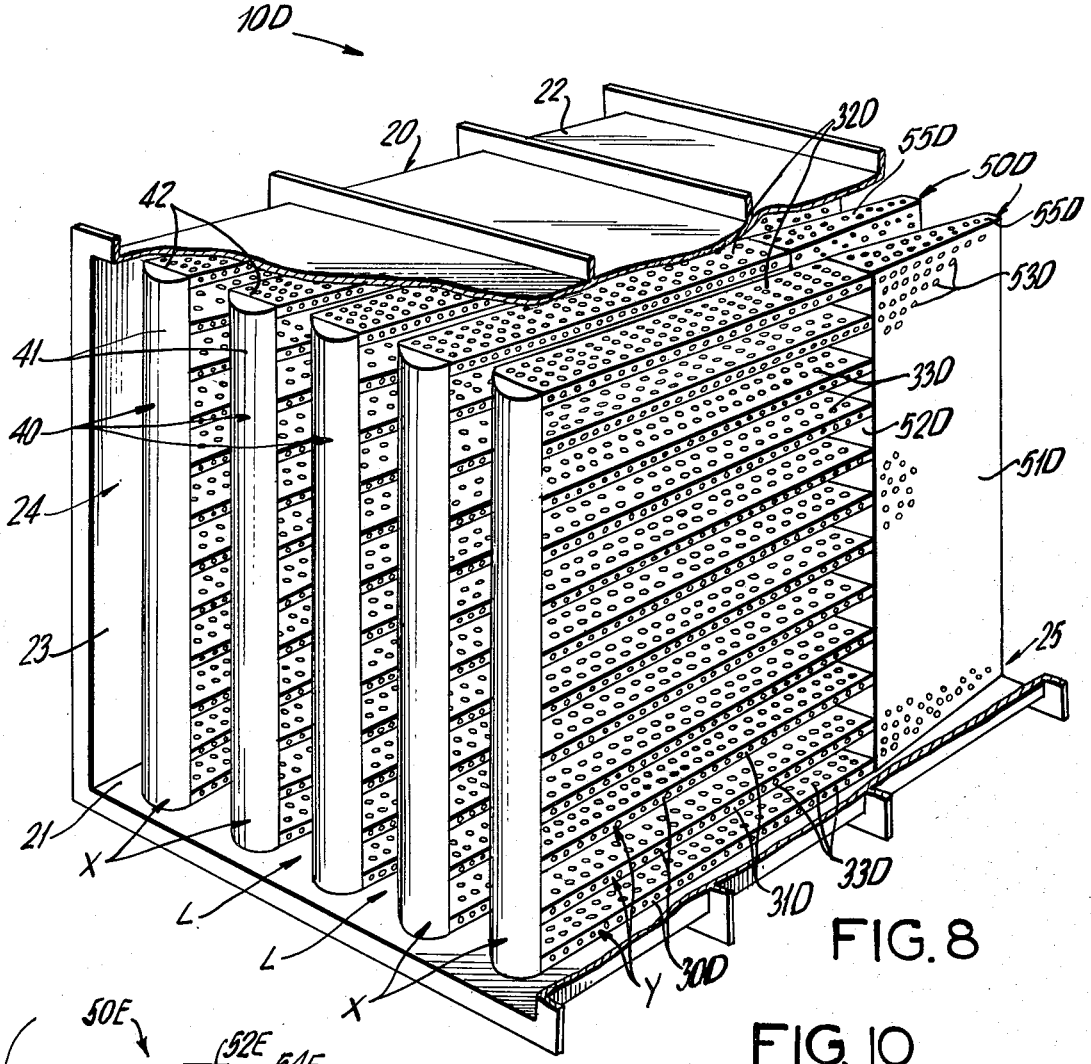
FIG. 8
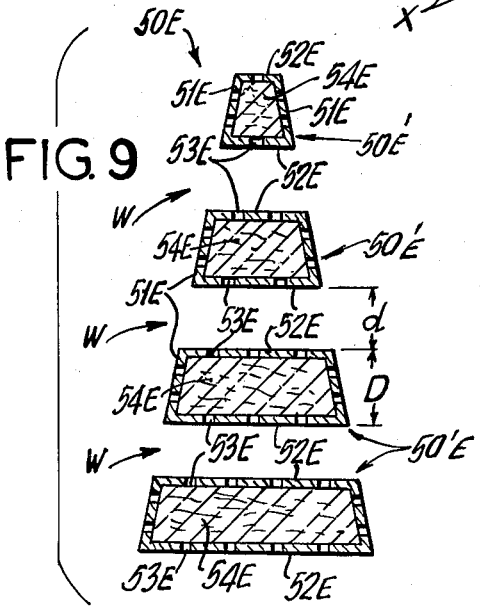
FIG. 9
FIG. 10
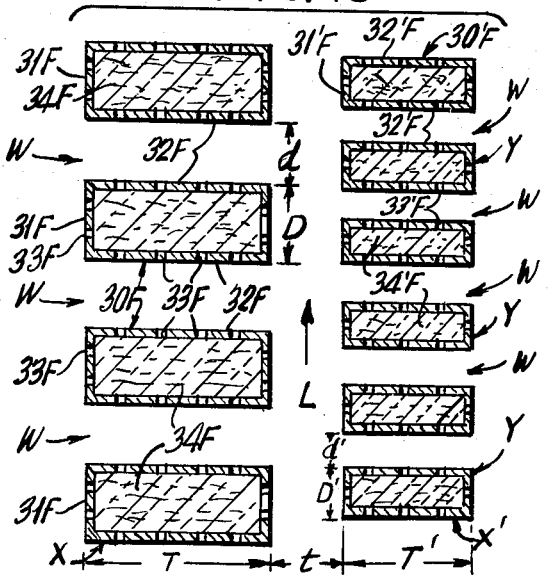

ACOUSTIC FILTER SILENCER

BACKGROUND OF THE INVENTION

1. Field of the Invention

The present invention relates to structures adapted to attenuate sound normally accompanying the flow of a fluid medium such as air or gas streams in a confined place, and more particularly to an acoustical gas flow silencer which may be typically used in heating, ventilating and air conditioning systems, power plants, engine intakes and exhausts, process blowers and compressors, etc. The silencer of the present inventors may include sound absorptive (dissipative) elements as well as reactive (nondissipative) configurations and may function as a combined dissipative and reactive attenuator or as a purely reactive one.

2. Description of the Prior Art

One type of silencer that is in common use is a splitter silencer which generally consists of baffles containing sound absorptive materials, of varying lengths and thicknesses, disposed parallel to the direction of the fluid stream flow. The sound absorptive materials are usually protected by perforated metal sheets or screens and, for very high velocity applications, by additional materials. Because of this silencer's reliance on sound absorptive material for the attenuation of noise, it may generically be called a "dissipative" type silencer, and the term "dissipative" will be used herein to define such a silencer. One advantage of the "dissipative" type of splitter silencer is that with good aerodynamic design it has a relatively low pressure drop. This feature makes the silencer particularly well-suited for applications involving large volumes of fluid flow. It will be understood that pressure drop is always an important factor in that the lesser the amount of energy required to push fluids through the silencers and other system components, the more energy is available for other purposes such as generating electricity or producing other marketable goods. Pressure drop is, of course, also very important in situations where air supply is marginal to begin with. Another advantage of dissipative type splitter silencers is that they are generally effective in attenuating noise in a wide range of both high and low frequencies.

There is, however, a significant shortcoming associated with the use of dissipative type splitter silencers in "dirty" environments such as steel plants, food processing operations, coal mines, aluminum reduction plants, power plants, and in particular, coal fired power plants which generate a significant amount of fly ash. More particularly, when dissipative type splitter silencers are used in such environments, the perforations of the silencer's absorptive surfaces tend to become clogged by the particulate contaminants contained in the fluid passing through the silencer. This clogging results in significant losses in the noise reduction characteristics of the silencer, and so, undesirably frequent cleaning of the sound absorptive surfaces is required.

With certain fan or air/gas handling applications, as in power plants, for instance, the undesirable noise encountered is often due to certain discrete tones which may be attributable to the fan blade pass frequency. These frequencies usually lie in a relatively broad low frequency range such as from about 100 to 500 Hz. A particular type of dissipative splitter silencer which has been suggested for use in environments such as power plants is one in which the absorptive surfaces thereof are largely contained within pockets on each side of the splitter and are separated by means of a solid spline. However, this type of silencer, in addition to a clogging problem, also suffers from a further related problem. More particularly, the pockets of this type of splitter silencer, which are essentially at right angles to the direction of fluid flow, act as collectors for the particulate contaminants in the fluid. Thus, in addition to clogging the sound absorptive surfaces inside the pockets, they facilitate the build-up of accumulating contaminants. Further, the typical construction of these particular silencers is such that ready access can not be had to the portions of the silencer where the fluid contaminants have collected so as to hinder cleaning and declogging of the silencer. It will be noted that the noise reduction characteristics of the silencer will be seriously impaired by such accumulations. This is particularly significant in power plants. Power plants are constructed so as to be operative for periods on the order of forty or more years. Silencers, therefore, should be useful and accessible for maintenance for the same length of time. It will be appreciated that if a power plant had to shut down for any reason, the economic and social impact can be enormous.

From the above, it will be understood that a silencer which will attenuate the relatively broad low range of frequencies typically encountered in power plants, independent of the functioning of potentially clogged dissipative components, i.e., the perforated or screened plates covering the acoustically absorptive material, is highly desirable.

Another type of silencer in use is commonly called a "reactive" type silencer. As used herein a "reactive" type silencer refers to a silencer which is not dependent on the presence of sound absorptive or flow resistant materials. Reactive silencers attenuate sound predominantly by virtue of volumetric relationships and the reflection of energy, rather than by use of sound absorptive materials, thus avoiding the above-mentioned clogging problem associated with dissipative type silencers. However, reactive type silencers generally operate effectively only over a relatively narrow frequency range, and thus, do not provide an optimum solution to noise reduction in environments such as power plants.

Accordingly, it is an object of the present invention to provide a sound silencer which, while employing sound absorptive material, is so constructed so as to retard clogging, minimize the need for cleaning, and maintain effective noise attenuation over a wide range of high and low frequencies for longer periods of time than known silencers.

It is another object of the present invention to provide a sound silencer having the above characteristics which can effectively attenuate noises in a relatively wide range of frequencies even when the perforated plates or screens covering the acoustically absorptive material are clogged by contaminants such as fly ash in the fluid stream which flows through the silencer.

It is a further object of the present invention to provide a sound silencer having the above characteristics and which also maintains a low degree of pressure drop.

It is another object of the present invention to provide a sound silencer which is constructed so as to provide ready access to the portions thereof where contaminants may collect for easy cleaning thereof when necessary.

It is another object of the present invention to provide a sound silencer of the reactive type as defined above, i.e., which does not require any sound absorptive materials or surfaces, which effectively attenuates sound over a relatively broad frequency range while retaining low pressure drop characteristics.

SUMMARY OF THE INVENTION

In accordance with the above recited objectives, the present invention provides an acoustic filter silencer for insertion in a duct having a fluid stream flowing therethrough. The silencer comprises an outer housing which is preferably substantially rectangular in cross-section having an open entry end, an opposed open exit end, a base portion, a roof portion, and a pair of opposed sidewalls. It will be noted that the housing may also have configurations other than rectangular, and in addition, the subject silencer may be constructed so as to be unitary with the fluid duct. The preferred embodiment of the silencer of the present invention further comprises a plurality, of spaced apart, generally parallel sound-attenuating members which are disposed either substantially upright within the housing, extending from the base of the housing to the roof thereof, or longitudinally within the housing, extending from the entry end of the housing to the exit end thereof. When upright, the sound attenuating members are disposed substantially normal to the housing base, whereas when longitudinal, they are disposed substantially parallel to the housing base. In either case, the sound attenuating members are arranged in columns and rows which define a first plurality of through passageways which are disposed substantially parallel to the direction of the main flow of the fluid stream and extending from the entry end of the housing to the exit end thereof, and a second plurality of through passageways which are disposed substantially perpendicular to the direction of the main flow of the fluid stream and extending from one of the housing side walls to the other side wall thereof. Preferably, each of the sound attenuating members is substantially rectangular in cross section having first and second pairs of opposed faces. The sound attenuating members may also have other configurations, however, such as trapezoidal, round etc. so as to effect the reflecting of the fluid between adjacent sound alternating members.

In the preferred embodiment of the present invention, each of the sound attenuating members is filled with a sound absorptive material, with each of the operative faces of the members (opposed pairs of faces contacting the fluid medium) being acoustically transparent. The operative faces of the sound attenuating members may be constructed from unitary perforated plates or screens, perforated channels and removable perforated plates, or simply opposed perforated channels which effect the exposure of the sound absorptive material within the members to the fluid stream flowing through the silencer. This embodiment combines maximum sound absorptive (dissipative) effect with the overall reactive configuration of the silencer and results in noise attenuation in a wide range of frequencies on the order of about 60 to 10,000 Hz.

In another embodiment of the present invention, it is contemplated that some of the operative surfaces of the sound attenuating members be acoustically opaque while others are acoustically transparent. Such an embodiment, also combines both dissipative elements and reactive configurations, and may be utilized where less high frequency attenuation is required than that provided by the previously described embodiment. However, it effects better or substantially the same noise attenuation of the lower frequencies which lie in a range on the order of about 100 Hz to about 700 Hz. These are frequencies typically encountered in power plants.

In a further embodiment of the present invention, it is contemplated that all of the operative surfaces of the sound attenuating members be acoustically opaque (solid without perforations) and do not include any exposed sound absorptive surfaces. This embodiment may be called a purely reactive silencer, and while exhibiting reduced noise reduction characteristics in high frequencies compared with the previously described embodiments (which combine dissipative elements and reactive configurations), effects better or substantially the same noise attenuation in a low frequency range on the order of about 100 Hz to about 500 Hz, again a range typically encountered in power plants.

BRIEF DESCRIPTION OF THE DRAWINGS

FIG. 8 is a perspective view, cut away in part, of a fourth embodiment of the silencer of the present invention.

FIG. 9 is a cross-sectional view of a modified tail member as illustrated in FIG. 2.

FIG. 10 is a cross-sectional view of a fifth embodiment of the silencer of the present invention.

DETAILED DESCRIPTION OF THE PREFERRED EMBODIMENTS

Figure 1:
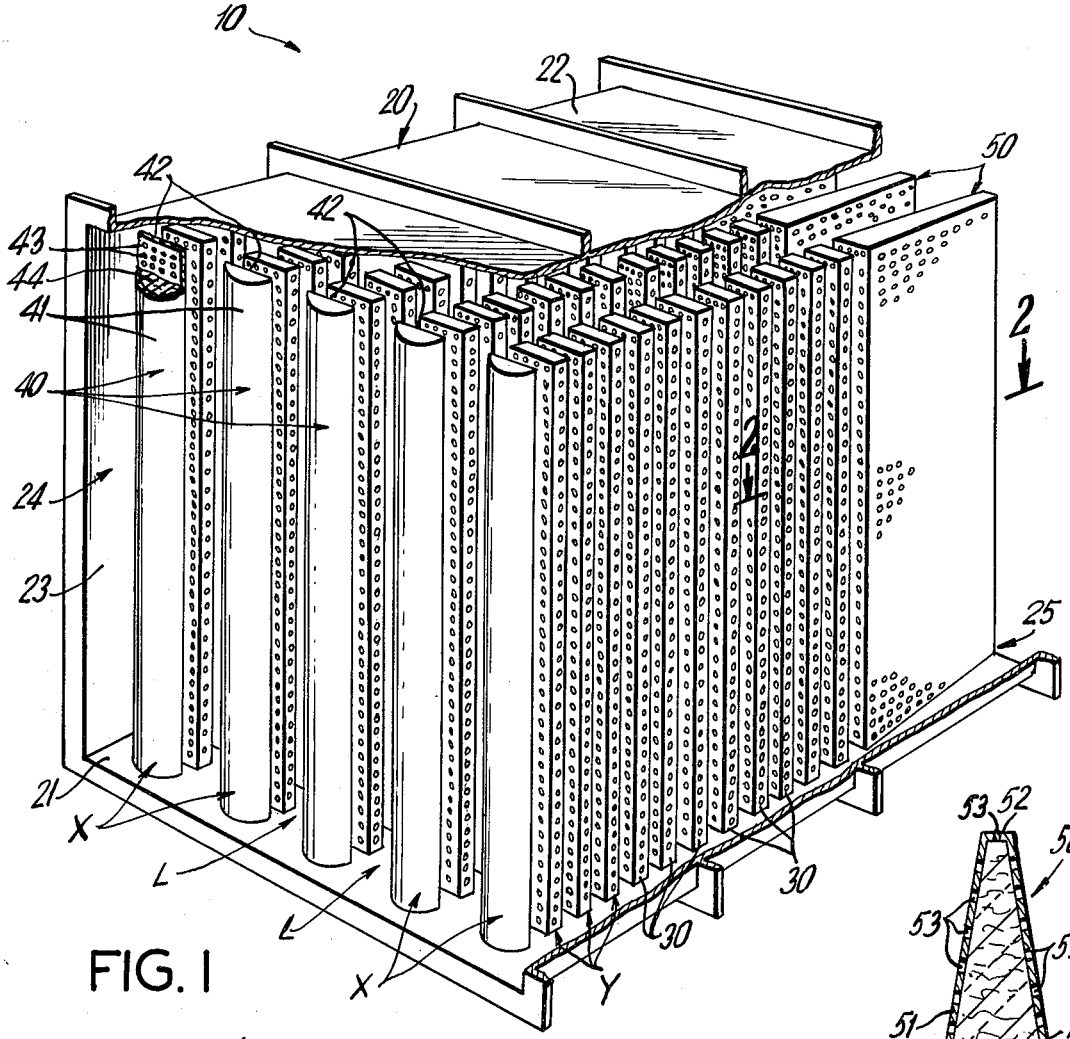
FIG. 1 is a perspective view, cut away in part, of the preferred embodiment of the silencer of the present invention.
Figure 2A:
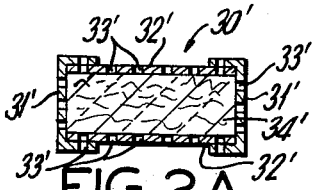
FIG. 2A is a cross-sectional view of an alternate embodiment of one of the sound attenuating members illustrated in FIG. 2.
Figure 2B:
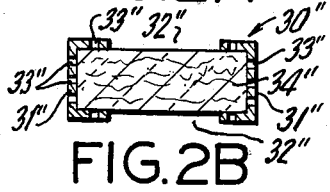
FIG. 2B is a cross-sectional view of an another alternate embodiment of one of the sound attenuating members illustrated in FIG. 2.
Figure 2:
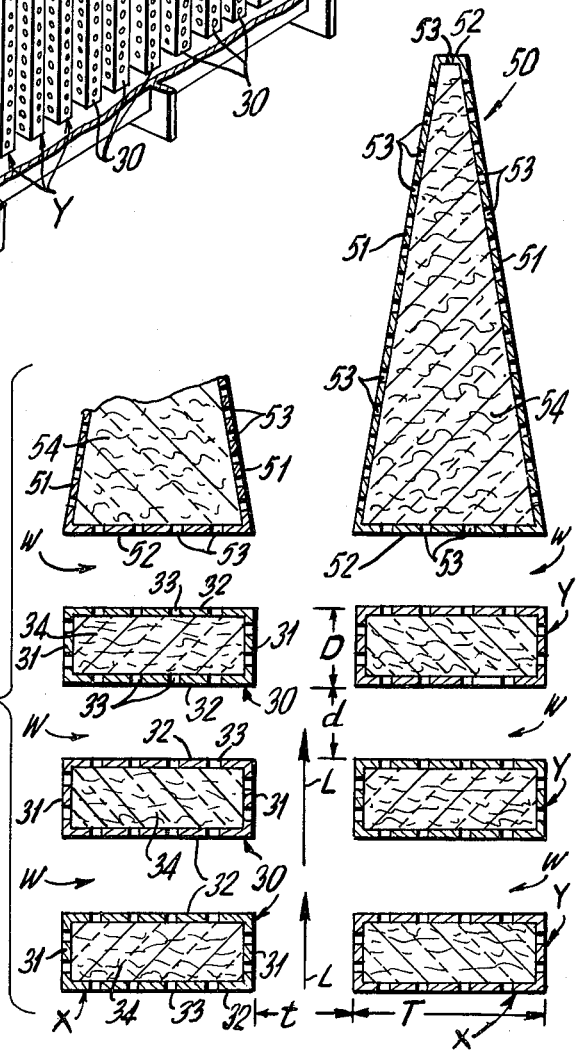
FIG. 2 is a partial cross-sectional view of the silencer of the present invention taken along line 2—2 of FIG. 1.

Referring to FIGS. 1 and 2, the preferred embodiment of the silencer of the present invention is designated generally by reference numeral 10 and includes a housing 20 which may be substantially rectangular in cross-section and is adapted to be installed between duct or conduit sections through which flows a fluid medium. As illustrated, housing 20 includes a base portion 21, a roof portion 22, a pair of opposed side walls 23 (one shown), an open entry end portion 24, and an open exit end portion 25. The main flow of the fluid stream passing through silencer 10 is from entry end 24 of housing 20 to exit end 25 thereof. Although not shown, housing 20 may include a door or hatch member for permitting access to the silencer interior for cleaning. It will be noted that while housing 20 is shown as having a rectangular cross-section, other configurations may also be employed. In addition, although the figures illustrate silencer 10 as being selfcontained, i.e., having its own housing 20, the silencer may be constructed inside existing duct or conduit systems thus not requiring an independent housing.

The subject silencer 10 further comprises a plurality of spaced apart, generally parallel sound attenuating members 30 which are disposed substantially upright within housing 20. In accordance with the present invention, sound attenuating members 30 are arranged in columns X and rows Y, each of the members 30 being disposed substantially normal to housing base 21 and extending from base 21 to housing roof 22. As shown most clearly in FIG. 2 the columns and rows of attenuating members 30 define a first plurality of through passageways L which are disposed parallel to the direction of the main flow of the fluid stream and extend from the entry end 24 of housing 20 to the exit end 25 thereof, and a second plurality of through passageways W which are disposed perpendicular to the direction of the main flow of the fluid stream and extend from one of the housing sidewalls 23 to the other sidewall thereof.

As illustrated in FIGS. 1 and 2 sound attenuating members 30 may be substantially rectangular in cross-section having a first pair of opposed faces 31 which are disposed substantially parallel to through passageways L and a second pair of opposed faces 32 which are disposed substantially parallel to through passageways W. In accordance with this embodiment of the invention, each of the sound attenuating members 30 is substantially filled with a sound absorptive material 34 such as foam, rockwool, fiberglass or other acoustically absorptive bulk material, and each of the operative faces 31 and 32 of members 30 is acoustically transparent. As illustrated in FIGS. 1 and 2, this acoustical transparency may be effected by the inclusion of perforations 33 in metal faces 31 and 32. It will be noted, however, that faces 31 and 32 may take on other foraminous or acoustically transparent constructions such as, for example, wire mesh screen or the like, and they may be formed from non-metallic materials such as plastics. In addition, while sound attenuating members 30 are illustrated in FIGS. 1 and 2 as having unitary faces 31 and 32, alternate constructions may be employed. Thus, as illustrated in FIG. 2A sound attenuating members 30' may include sound absorptive material 34' which is enclosed by opposed perforated (or screened) channel members 31' which are disposed substantially parallel to passageways L and opposed perforated (or screened) plates 32' which are disposed substantially parallel to passageways W, plates 32' being removable so as to facilitate cleaning. As further illustrated in FIG. 2B, sound attenuating members 30'' may comprise opposed perforated (or screened) channel members 31'' which are disposed substantially parallel to passageways L, and opposed surfaces 32'' which are substantially open so as to expose sound absorptive material 34''.

Referring again to FIG. 1, silencer 10 may further include a plurality of spaced apart nose members 40, each of which being aligned with one of the columns X of sound attenuating members 30, and disposed adjacent entry end portion 24 of silencer housing 20. Each nose member 40, includes a convex rounded end wall 41 disposed directly adjacent entry end portion 24 of the silencer housing and an opposed planar end wall 42 disposed substantially parallel to the passageway W directly adjacent thereto. Silencer 10 also preferably includes a plurality of tail members 50, each of which being aligned with one of the columns X of sound attenuating members 30, and diposed adjacent exit end portion 25 of silencer housing 20. Each tail member 50 includes a pair of opposed end walls 52 (see FIG. 2) disposed substantially parallel to passageways W, and a pair of converging sidewalls 51 which are disposed at an angle relative to passageways L. As shown in FIGS. 1 and 2, nose members 40 may typically include sound absorptive filler 44, solid (non-perforated) i.e., not sound absorptive faces 41, and sound absorptive faces 42 having perforations 43. Tail members 50 may include sound absorptive filler 54 and acoustically transparent, i.e., sound absorptive faces 51 and 52 having perforations 53. It will be noted, however, that nose members 40 may also be constructed such that both faces 41 and 42 are solid, i.e., acoustically opaque. In addition, tail members 50 may also be constructed such that faces 51 and 52 are all solid or some perforated (screened) and some solid. It will be understood that where the faces of tail members 50 are acoustically transparent they may have a construction similar to that of sound attenuating members 30' and 30'' illustrated in FIGS. 2A and 2B. In addition, the subject tail members may be constructed so as to be segmented into a second plurality of tail sound attenuating sections. More particularly, referring to FIG. 9, each tail member 50 may comprise a plurality of tail sound attenuating sections 50'E, each of which being substantially trapezoidal in configuration having a pair of opposed parallel faces 52E disposed parallel to passageways W, and a pair of faces 51E disposed at an angle to passageways L. Each tail sound attenuating section is disposed substantially normal to the base of the silencer housing and extends from the base to housing roof. It will be noted that each tail sound attenuating section 50'E is illustrated in FIG. 9 as including sound absorbtive material 54E and acoustically transparent faces 51E and 52E each having perforations 53E. However, tail sound attenuating sections 50E may be constructed such that faces 52E or faces 51E and 52E are acoustically opaque. In addition, they may have non-unitary construction similar to those illustrated in FIGS. 2A and 2B.

Referring again to FIGS. 1 and 2, in operation the fluid medium passes through silencer 10 from entry end portion 24 to exit end portion 25. While the main flow of the fluid medium passes through passageways L, with little, if any, of the fluid passing through passageways W, the noise associated with the flow is attenuated by the absorptive material contained in sound attenuating members 30 via both pairs of acoustically transparent surfaces 31 and 32 (and 51 & 52), and attenuated thereby with the overall reactive configuration of the silencer. When the silencer is used in "dirty" environments, i.e., where the fluid contains a significant amount of contaminants, surfaces 31 (and 51) will become clogged by the contaminants after a period of time. However, because little fluid flows through passageways W, surfaces 32 (and 52) will remain unclogged for a much longer period of time thus extending the effective period of sound absorption. In addition, when periodic cleaning of the silencer is desired, it may be done readily and efficiently, especially in the embodiments illustrated in FIGS. 2A and 2B wherein the acoustically transparent faces may be removed for cleaning, and others substituted (FIG. 2A), or the sound absorptive material removed and new material inserted (FIG. 2B). Finally, as will be described below, whereas the unclogged silencer depicted in FIGS. 1, 2, 2A and 2B combines maximum sound absorptive effect with the overall reactive configuration of the silencer so as to effectively attenuate noise in a wide frequency range on the order of about 60 to 10,000 Hz, the silencer is still quite effective in the relatively broad low frequency range of about 100 to 500 Hz typically encountered in power plants even if all of the operative surfaces of the subject sound attenuating members become clogged.

Figure 4A:
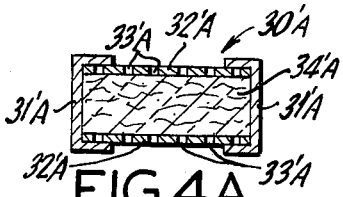
FIG. 4A is a cross-sectional view of an alternate embodiment of one of the sound attenuating members of FIG. 4.
Figure 4B:
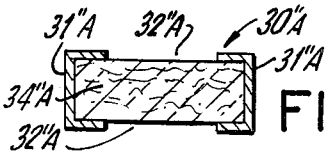
FIG. 4B is a cross-sectional view of another alternate embodiment of one of the sound attenuating members of FIG. 4.
Figure 3:
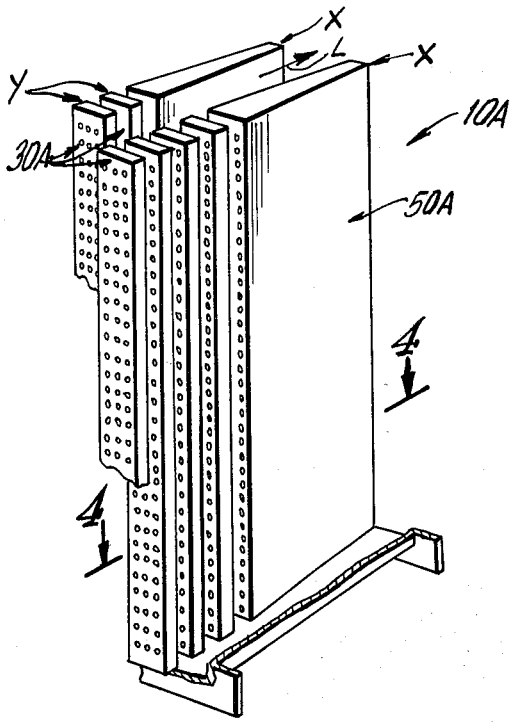
FIG. 3 is a partial perspective view, cut away in part, of a second embodiment of the sound silencer of the present invention.
Figure 4:
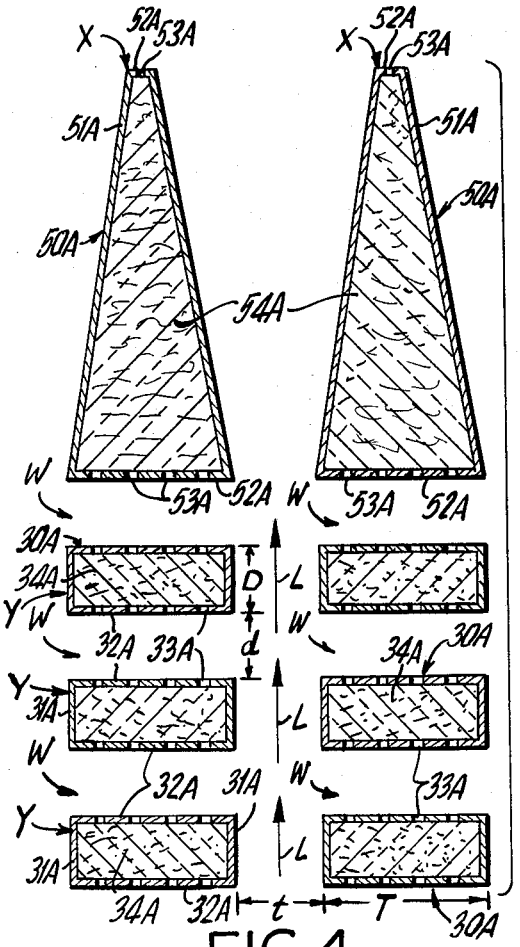
FIG. 4 is a cross-sectional view of the sound silencer of the present invention taken along line 4—4 FIG. 3.

Turning now to FIGS. 3 and 4, an alternate embodiment of the silencer of the present invention, which is designated generally by reference numeral 10A, is illustrated. For the sake of simplicity only partial perspective and cross-sectional views of this embodiment are shown. It will be understood that the portions of the silencer not shown such as the housing, nose members, etc., are identical in configuration to the corresponding elements illustrated in FIGS. 1 and 2, and that like references in FIGS. 3 and 4 relate to identical components in FIGS. 1 and 2. Referring to FIGS. 3 and 4 in detail, silencer 10A includes a plurality of spaced apart sound attenuating members 30A which are disposed substantially normal to the housing base 21 and are arranged in columns X and rows Y so as to define first and second pluralities of perpendicular through passageways L and W. Passageways L are disposed substantially parallel to the direction of the main flow of the fluid stream and passageways W are disposed substantially perpendicular to the direction of the main flow of the fluid stream. As illustrated in FIGS. 3 and 4 sound attenuating members 30A may be generally rectangular in cross-section having a first pair of opposed faces 31A which are disposed substantially parallel to through passageways L, and a second pair of opposed faces 32A which are disposed substantially parallel to through passageways W. In accordance with this embodiment of the present invention, each of sound attenuating members 30A is filled with a sound absorptive filler material 34A, with faces 31A being acoustically opaque and faces 32A being acoustically transparent. As shown, faces 32A include perforations 33A, but it will be understood that any means for providing faces 32A with acoustical transparency may be employed. In addition, it will be understood that members 30A may be other than rectangular in cross-section, and that faces 31A and 32A may be non-unitary. Thus, as illustrated in FIG. 4A sound attenuating members may include acoustically opaque opposed channel members 31'A and acoustically transparent faces 31'A which are removable to facilitate cleaning. As further illustrated in FIG. 4B sound attenuating members 30''A may include acoustically opaque opposed channel members 31''A and opposed faces 32''A which are substantially open so as to expose sound absorptive material 34''A.

Further referring to FIGS. 3 and 4 it will be noted that silencer 10A may include tail members 50A (in addition to nose members not shown but identical to those illustrated in FIG. 1) having a pair of opposed end portions 52A which are disposed substantially parallel to through passageways W and a pair of converging sidewalls 51A which are disposed at an angle relative to through passageways L. In this embodiment tail members 50A are again filled with sound absorptive material 54A but end portions 52A are acoustically transparent having perforations 53A while sidewall portions 51A are acoustically opaque. It will be noted that in addition to the unitary construction illustrated in FIGS. 3 and 4, tail members 50A may have a construction similar to that of sound attenuating members 30'A and 30''A shown in FIGS. 4A and 4B, and/or that of tail member 50E shown in FIG. 9.

As will be described in more detail below, the embodiment of the subject silencer depicted in FIGS. 3, 4, 4A, and 4B attenuates noise by sound absorption and the overall reactive configuration of the silencer in substantially the same overall frequency range of the silencer of FIGS. 1, 2, 2A and 2B. However, the silencer exhibits lower noise reduction characteristics in the higher frequencies, i.e. over 700 Hz, which is attributable to the fact that some of the surfaces of the sound attenuating members are acoustically opaque, i.e., non-absorptive. It will be noted, however, that such a construction enables the silencer to exhibit noise attenuation characteristics which are better or substantially the same as the previously described embodiment in the relatively broad low frequency range on the order of 100 to 700 Hz. Thus, the silencer of FIGS. 3, 4, 4A and 4B is quite suitable for attenuating noise frequencies typically encountered in power plants.

Figure 5:
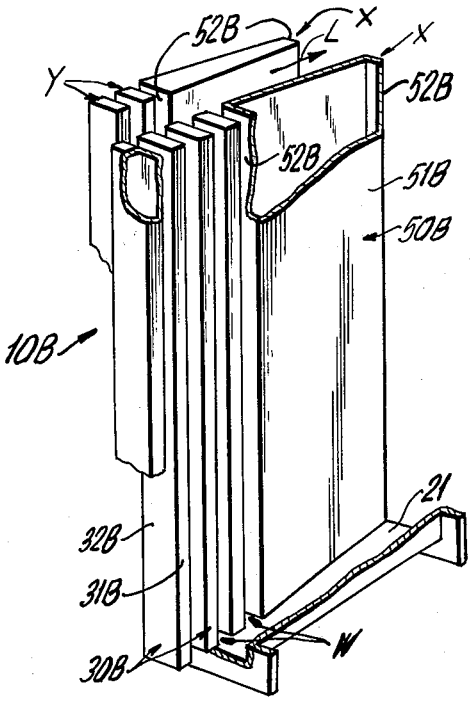
FIG. 5 is a perspective view, cut away in part, of a third embodiment of the sound silencer of the present invention.

Turning now to FIG. 5, another embodiment of the silencer is illustrated. More particularly, FIG. 5 illustrates a silencer, designated generally by reference numeral 10B, which may be termed a purely reactive silencer, as opposed to the silencers of FIGS. 1–4B which include both sound absorptive (dissipative) and reactive components. Again for the sake of simplicity only a partial view of this embodiment of the present invention is illustrated in FIG. 5 in that the portions not shown (such as the housing and nose members) are identical to the components illustrated with respect to the previously described embodiments, and that like references in FIG. 5 relate to components identical to those in FIGS 1–4.

Referring to FIG. 5 in detail, silencer 10B includes a plurality of spaced apart sound attenuating members 30B which are disposed substantially normal to the housing base 21 and are arranged in columns X and rows Y so as to define first and second pluralities of perpendicular through passageways L and W. Passageways L are disposed substantially parallel to the direction of the main flow of the fluid stream and passageways W are disposed substantially perpendicular to the direction of the main flow of the fluid stream. As illustrated in FIG. 5 sound attenuating members 30B may be generally rectangular in cross-section having a first pair of opposed faces 31B which are disposed substantially parallel to through passageways L, and a second pair of opposed faces 32B which are disposed substantially parallel to through passageways W. In accordance with this embodiment of the present invention, each face 31B and 32B is acoustically opaque, i.e., non-absorptive. As illustrated in FIG. 5 sound attenuating members 30B are hollow (empty), but they also may be completely solid and/or contain acoustical filler or other sound dampening materials. They also may be non-rectangular in configuration.

Further referring to FIG. 5 it will be noted that silencer 10B may also include tail members 50B (in addition to nose members not shown but identical to those illustrated in FIG. 1) having a pair of opposed end portions 52B which are disposed substantially parallel to through passageways W and a pair of converging sidewalls 51B which are disposed at an angle to through passageways L. In this embodiment, tail member surfaces 51B and 52B are acoustically opaque (non-absorptive). Again while tail members 50B are depicted in FIG. 5 as being hollow (empty), they may be solid and/or filled with acoustical filler or other sound dampening material. In addition they may have a segmented construction similar to that illustrated in FIG. 9. In operation, as the fluid medium flows through the silencer it is separated into portions which pass through passageways L and W, the bulk of the fluid passing through passageways L. The sound attenuation is effected by the reactive configuration of the silencer which provides, in effect, interacting impedances and capacitances.

In order to determine their noise reduction characteristics, silencers constructed in accordance with the present invention, as described above, were tested. In each case, the silencer was approximately 9 feet 4 inches long and was tested at a face velocity of 1,000 feet per minute. Each of the sound attenuating members of the silencers was approximately $10\frac{5}{8}'' \times 4''$ in cross-section with each column of members being laterally spaced apart about $5\frac{3}{8}''$, and longitudinally spaced apart about 4".

EXAMPLE 1

A silencer was constructed as taught by FIGS. 1, 2, 2A and 2B, i.e. wherein all of the sound attenuating members, nose members, and tail members were substantially filled with sound absorptive material, and all of the operative surfaces of the sound attenuating members and tail members, and the planar face of each nose member were acoustically transparent.

EXAMPLE 2

A silencer was constructed as taught by FIGS. 3, 4, 4A, and 4B, i.e., wherein the sound attenuating members, nose members and tail members were substantially filled with sound absorptive material, and the operative surfaces of said members disposed parallel to the main flow of fluid were acoustically opaque (solid), while the operative surfaces disposed perpendicular to the main flow of the fluid were acoustically transparent. It will be noted that such a construction also simulates the state of the silencer of Example 1 after it has been in use for a period of time in a "dirty" environment and has become partially clogged by contaminants, such as fly ash.

EXAMPLE 3

A silencer was constructed as illustrated in FIG. 5, i.e., wherein all of the operative surfaces of the sound attenuating members, nose members and tail members were acoustically opaque. In this embodiment the subject silencer operates as a purely reactive silencer having no dependence on sound absorptive or flow resistive materials. It will be noted that such a construction simulates the state of the silencer of Example 1 after it has been used in a "dirty" environment for a relatively long period of time such that all of the operative surfaces of the silencer's sound attenuating members, nose members, and tail members have been clogged by contaminants in the fluid.

Figure 7:
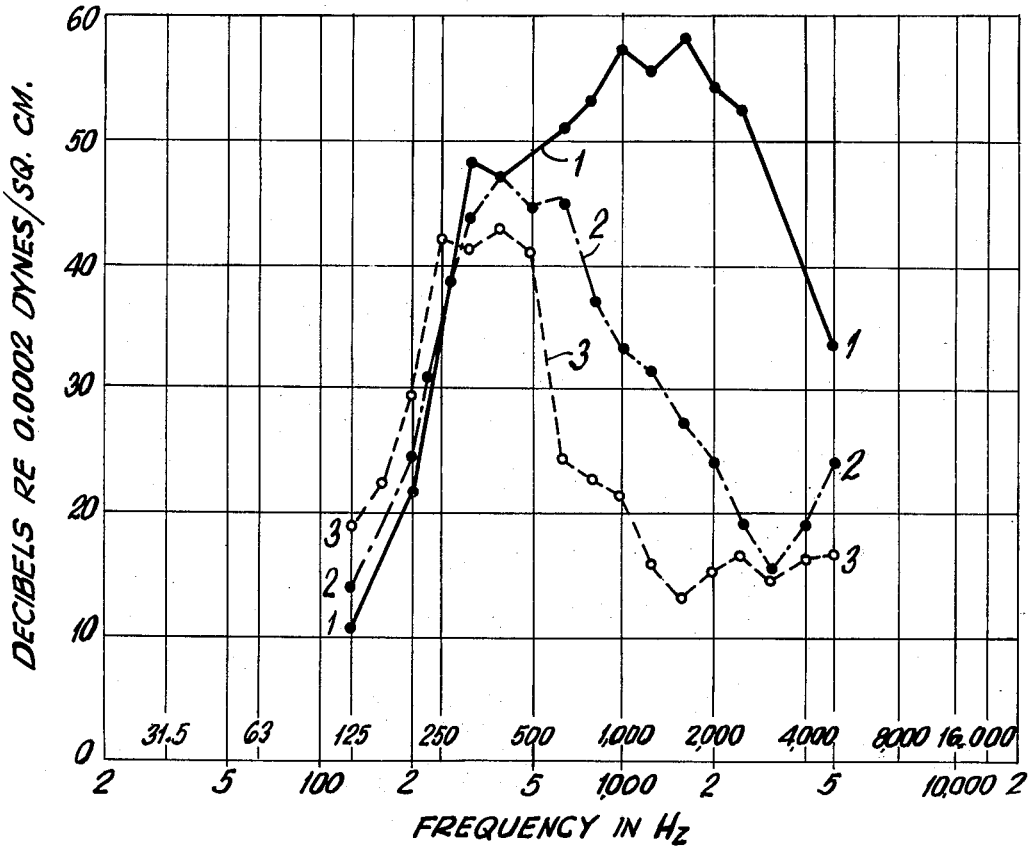
FIG. 7 is a graph of the acoustical dynamic insertion loss at 1,000 feet per minute face velocity for a silencer of the present invention having a 33% open flow area under three operating conditions.

Referring now to FIG. 7, there is illustrated, in graph form, the noise attenuation characteristics of the silencers constructed in Examples 1, 2 and 3. Graph 1 reflects the noise attenuation characteristics of the silencer of Example 1, and as shown, said silencer very effectively attenuated noise in a wide range of high and low frequencies on the order of at least about 125 to 5000 Hz. Graph 2 reflects the noise attenuation characteristics of the silencer of Example 2, and as shown, said silencer effectively attenuated noise in a similar frequency range as the silencer of Example 1, i.e. on the order of about 125 to 5000 Hz. However, it will be noted that whereas the silencer of Example 2 had reduced noise attenuation characteristics in the relatively high frequency range of about 700 to 5000 Hz as compared to the silencer of Example 1, the silencer of Example 2 actually attenuated noise better than the silencer of Example 1 in the low frequency range of from about 125 to 315 Hz, and it exhibited substantially the same noise attenuation characteristics as the silencer of Example 1 in the range of about 315 to 700 Hz. Graph 3 reflects the noise characteristics of the silencer of Example 3, and as shown, said silencer has reduced noise attenuation characteristics as compared with the silencers of Example 1 and 2 in the higher frequency range of about 500 to 5000 Hz. However, in the relatively wide low frequency range of about 125 to 250 Hz the silencer of Example 3 attenuated noise better than the silencers of Examples 1 and 2, and in the range of about 250 to 500 Hz, it exhibited substantially the same noise attenuation characteristics as the silencers of Examples 1 and 2. It should be noted that while the terminal points depicted in each of graphs 1–3 of FIG. 7 are 125 Hz and 5000 Hz, these cut-off points were only selected as a matter of convenience for easily comparing the results obtained from the silencers of Examples 1–3. As a matter of fact, said silencers effectively attenuated noise in a wider range, specifically, on the order of about 60 to 10,000 Hz.

Referring to Examples 1–3 and FIG. 7 as a whole, it will be understood that depending upon the particular noise attenuation characteristics desired, the silencer of the present invention may take on various constructions. Thus, where high noise attenuation over a wide range of high and low frequencies is required, it is preferable to use the silencer constructed as in Example 1, i.e. where all of the sound attenuating members, nose members and tail members include sound absorptive material, and all of the operative surfaces of the sound attenuating members and tail members and the planar faces of the nose members are acoustically transparent. Such a construction combines maximum dissipative effect, i.e., sound absorption, with the reactive noise attenuation effect provided by the overall configuration of the silencer. Where a particular application requires high noise attenuation in a relatively wide low frequency range, such as on the order of about 125 to about 700 Hz, rather than in a wide range of high and low frequencies, the silencers of Examples 2 and 3 may be employed, the essentially reactive silencer of Example 3 having the best noise attenuation characteristics in the low frequency range of about 125 to 250 Hz. In addition, while the silencers of Examples 1–3 were constructed with certain fixed dimensions, such dimensions may be varied to obtain desired acoustical performance characteristics. More particularly, referring to the Figures it will be noted that the dimensions for the depth D of each sound attenuating member, the longitudinal spacing d between each sound attenuating member, the width T of each sound attenuating member, and the lateral spacing t between each sound attenuating member, as well as the overall length and width of the silencer, may be varied in different combinations to achieve desired results. For example, increasing T while maintaining constant D, d, and the overall length and width of the silencer, improves the low frequency attenuation effected by the silencer. Decreasing dimensions d and D while maintaining constant dimensions T, t and the overall length and width of the silencer improves both low and high frequency attenuation where the sound attenuating members are filled with sound absorptive material and have acoustically transparent faces.

Referring again to FIG. 7, it will be noted that each of the silencers of Example 1–3 is well suited for use in "dirty" environments, i.e., wherein the fluid passing through the silencer has a significant amount of contaminants which may clog the silencer. More particularly, the silencer of Example 1, in the unclogged state, attenuates noise in the wide range of high and low frequencies reflected in Graph 1 of FIG. 7. After a period of use, the surfaces of the silencer's sound attenuating members and tail members which are disposed parallel to direction of the main fluid flow will become clogged, while the surfaces of said members which are disposed perpendicular to the direction of the main fluid flow as well as the planar faces of the nose members, will remain unclogged. Such a partially clogged silencer, of course, simulates or corresponds to the contruction of the silencer of Example 2, and thus, such a partially clogged silencer would retain high noise attenuation characteristics in the range of approximately 125 to about 700 Hz as reflected in Graph 2 of FIG. 7. After a longer period of use, without cleaning, the silencer of Example 1 would become completely clogged. However, even in a completely clogged state, the silencer would simulate or correspond to the construction of the purely reactive silencer of Example 3, and as reflected in Graph 3 of FIG. 7, would exhibit noise attenuation better than or at least substantially as good as the unclogged silencer of Example 1 in the low frequency range of from about 125 Hz to about 500 Hz.

Thus, all of the silencers of the present invention described above, are particularly well suited for use in "dirty" environments, such as coal fired power plants, wherein the critical or most objectionable noises are disposed in the relatively broad low frequency range on the order of about 100 to 500 Hz. They can effectively combine both dissipative and reactive sound attenuating components in parallel so as to achieve high noise attenuation in a wide range of high and low frequencies. Moreover, in the low frequencies typically encountered in power plants they behave acoustically the same or better when the silencer components (sound attenuating members, nose members and tail members) are reflective (solid or clogged) as when they have acoustically transparent or sound absorptive surfaces. And, the subject silencers, which do not include dimensionally limited acoustic chambers, achieve such pronounced reactive characteristics with little pressure drop and in a much broader low frequency range than is obtainable with known reactive silencers which generally do have definable volumetric chambers. Again, it will be noted that the terminal points of 125 and 5000 Hz reflected in each of the graphs of FIG. 7 were selected to show more clearly the comparative results obtained with the silencers of Examples 1–3, said silencers actually having attenuated noise effectively in a wider range on the order of about 60 to 10,000 Hz.

While reasons for the above described performance of the subject silencers may be speculated, no attempt will be made herein to explain it mathematically. It has been found that silencers, for all practical purposes, must be developed pragmatically through full or model scale testing.

Figure 6:
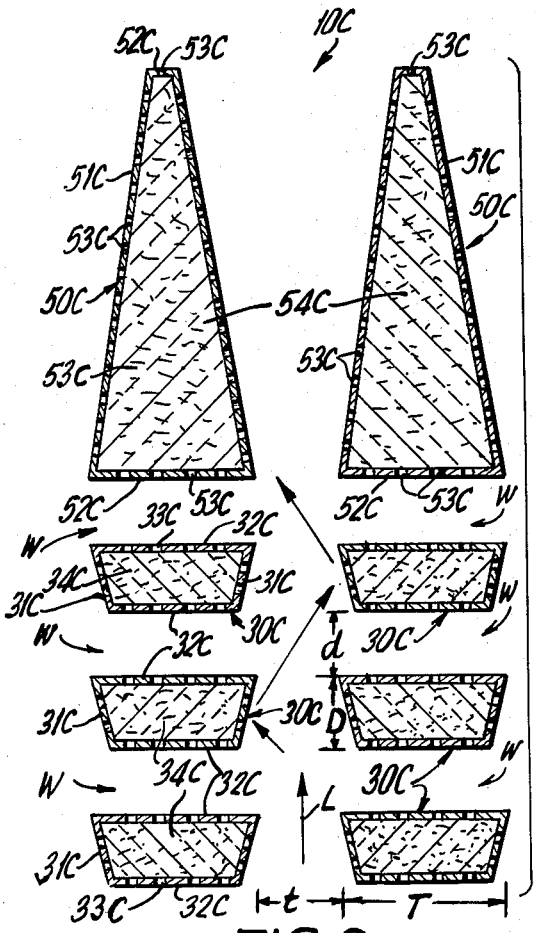
FIG. 6 is a cross-sectional view of an alternate embodiment of the silencer illustrated in FIG. 1.

Thus, while all of the above described preferred embodiments of the present invention illustrate the sound attenuating members as being substantially rectangular in cross-section, it will be noted that they may have other configurations which may enhance the performance of the silencer. Accordingly, referring to FIG. 6, the silencer which is designated generally by reference numeral 10C includes sound attenuating members 30C which are generally trapezoidal in configuration. More particularly, sound attenuating members 30C are filled with sound absorptive material 34C and include acoustically transparent faces 31C having perforations 33C disposed adjacent to and at an angle relative to fluid through passageways L, and acoustically transparent faces 32C disposed substantially parallel to fluid through passageways W. Similarly tail members 50C are filled with sound absorptive material 54C and include acoustically transparent converging sidewalls 51C having perforations 53C, sidewalls 51C being disposed adjacent to and at an angle relative to fluid through passageways L, and acoustically transparent surfaces 52C which are disposed substantially parallel to fluid through passageways W. The provision of surfaces 31C at an angle to passageways L effects the reflection of the fluid between the sound attenuating members 30C bordering each passageway L, and acts as an additional clogging retarder for surfaces 32C and 31C (and 51C and 52C). It will be noted that while the silencer of FIG. 6, which includes trapezoidal sound attenuating members 30C, has been illustrated as having a construction quite similar to that of FIGS. 1 and 2, i.e. with all the operative surfaces of the sound attenuating members 30C and tail members 50C being unitary and acoustically transparent, it is contemplated that the constructions depicted in FIGS. 2A, 2B, 3, 4, 4A, 4B,5, and/or 9 may also be employed.

Further to the teachings herein that many design modifications can be effected in the subject silencer while retaining the spirit of the present invention, reference is made to the silencer designated generally by reference numeral 10D in FIG. 8. Whereas all of the previously described embodiments of the invention illustrate sound attenuating members disposed upright within the silencer housing 20, silencer 10D of FIG. 8 includes sound attenuating members which are disposed longitudinally within the housing. More particularly, silencer 10D includes a plurality of spaced apart sound attenuating members 30D which extend from entry end 24 of the housing to exit end 25 thereof and are disposed substantially parallel to housing base 21. Sound attenuating members 30D are arranged in columns X and rows Y which define a first plurality of through passageways L extending from entry end 24 of housing 20 to exit end 25 thereof, and a second plurality of through passageways W which are perpendicular to passageways L and extend from one housing sidewall 23 to the other sidewall thereof.

As illustrated in FIG. 8 each sound attenuating member 30D is substantially rectangular in cross-section having a first pair of opposed faces 31D which are disposed adjacent passageways L and perpendicular to housing base 21 and a second pair of opposed faces 32D which are disposed adjacent passageways W and substantially parallel to housing base 21, each face being acoustically transparent and including perforations 33D. It will be noted that aside from the specific configuration illustrated in FIG. 8, sound attenuating members 30D may also be constructed similar to those illustrated in the preceding Figures such that faces 31D and 32D may be both acoustically transparent or both acoustically opaque, or 32D may be acoustically transparent while the faces 31D are acoustically opaque. In addition, sound attenuating members 30D may have non-unitary constructions similar to those illustrated in FIGS. 2A,2B,4A and 4B.

Further referring to FIG. 8 silencer 10D also includes a plurality of spaced apart nose members 40, each of which being aligned with one of the columns X of sound attenuating members 30D, and disposed adjacent entry end portion 24 of the silencer housing. Nose members 40 are identical in configuration to those illustrated in FIG. 1, and so, like reference numerals have been retained. Thus, each nose member 40 in FIG. 8 includes a convex rounded end wall 41 disposed directly adjacent housing entry portion 24, and an opposed planar end wall 42. Silencer 10D further includes a plurality of spaced apart tail members 50D, each of which being aligned with one of the columns of sound attenuating members 30D, and disposed adjacent housing exit portion 25. Each tail member 50D includes a pair of converging sidewalls 51D which are disposed at an angle to passageways L, a first pair of opposed faces 52D which are disposed substantially perpendicular to passageways L and base 21 and a second pair of opposed faces 55D which are disposed parallel to housing base 21. In accordance with the invention, one end of each sound attenuating member 30D is mounted to a nose member 40 while its other end is mounted to the corresponding tail member in the same column X. It will be noted that while each of the faces 55D and 51D of tail members 50D are illustrated as being unitary and both acoustically transparent, they may also be both acoustically opaque or one face may be acoustically opaque while the other is acoustically transparent. In addition, tail members 50D may take on a non-unitary construction similar to those illustrated in FIGS. 2A, 2B, 4A and 4B and/or be segmented similar to the tail member illustrated in FIG. 9.

As a further departure from or modification of the embodiments of the subject invention illustrated in FIGS. 1–6 reference is made to FIG. 10. Whereas all of the silencers illustrated in FIG. 1–6 comprise columns and rows of equally spaced and equally dimensioned sound attenuating members, it is contemplated in accordance with the subject invention, that the above referenced silencer dimensions T, D, t, and d may be varied within a given silencer so as to tune the silencer for particular noise reduction characteristics. Thus, the silencer depicted in FIG. 10 comprises alternating columns of sound attenuating members X and X'. Columns X comprise a plurality of sound attenuating members 30F each member having two pairs of opposed faces 31F and 32F. Each sound attenuating member has a width T and a depth D, is longitudinally spaced from an adjacent sound attenuating member a distance d and is laterally spaced from an adjacent column X' a distance t. Similarly, columns X' include a plurality of sound attenuating members 30'F each having two pairs of opposed faces 31'F and 32'F, a width T', a depth D' and a longitudinal spacing d' from its adjacent sound attenuating member. While each of the sound attenuating members 30F and 30'F are illustrated as including sound absorptive material 34F and 34'F, and acoustically transparent faces having perforations 33F and 33'F it will be noted that said sound attenuating members may be non-rectangular and have the configurations illustrated in FIGS. 1–6. It will be further noted that in addition to the provision of attenuating columns X and X', other combinations of the various silencer dimensions T, t, D, and d may be made so as to tune the silencer to obtain the desired noise reduction characteristics.

In summary, the present invention provides a new and improved silencer which can combine both reactive and dissipative sound attenuating components so as to be able to attenuate a wide range of high and low frequencies. Whereas, typical reactive silencers are generally always designed with definable volumetric chambers, the subject silencer has pronounced reactive characteristics even though the acoustic elements and the flow passageways defined thereby have the low pressure drop configuration similar to that of a splitter silencer. A very important feature of the silencer of the invention is that in the low frequencies, which are typically encountered in power plants, it behaves acoustically the same or better when the silencer components are reflective such as when clogged or otherwise, as when they have unclogged sound absorptive surfaces. Another important feature of the present invention is that the silencer has no pockets for accumulating contaminants, and that because of its particular construction it is readily cleanable. A further feature of the subject silencer is that its construction, in effect, retards the clogging of its components while the silencer is in use.

While there have been described herein what are at present considered preferred embodiments of the invention, it will be obvious to those skilled in the art that many modifications and changes may be made therein without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

What is claimed is:

1. A sound silencer for insertion in a duct having a fluid medium flowing therethrough comprising:

an outer-housing having an open entry end, an open exit end, a base portion, a roof portion, and a pair of opposed side walls; the main flow of the fluid medium being from the entry end of the housing of the exit end thereof; and a plurality of spaced apart sound attenuating members disposed within the housing, said sound attenuating members being arranged in columns and rows, each of said sound attenuating members being disposed substantially normal to said housing base and extending from said base to said housing roof such that said sound attenuating members define a first plurality of fluid passageways substantially parallel to the direction of the main flow of the fluid medium and extending from the entry end of the housing to the exit end thereof, and a second plurality of fluid passageways disposed substantially perpendicular to the direction of the main flow of the fluid medium and extending from one of said housing sidewalls to the other sidewall, each of said sound attenuating members having a first pair of opposed faces disposed substantially parallel to said first plurality of fluid passageways and a second pair of acoustically transparent opposed faces disposed substantially parallel to said second plurality of fluid passageways, said attenuating members being substantially filled with a sound absorptive filler material.

2. A sound silencer as recited in claim 1 which further comprises:

a plurality of spaced apart nose members, each nose member being aligned with one of the columns of sound attenuating members and disposed substantially normal to the housing base, each of said nose members having a convex rounded end wall disposed directly adjacent the housing entry end portion and an opposed planar end wall disposed substantially parallel to said second plurality of fluid passageways; and a plurality of spaced apart tail members, each of said tail members being aligned with one column of sound attenuating members and disposed adjacent the housing exit end portion, each of said tail members including a pair of opposed end walls disposed substantially parallel to said second plurality of fluid passageways, and a pair of converging sidewalls disposed at an angle to said first plurality of fluid passageways.

3. A sound silencer as recited in claim 2 wherein each of said tail members is segmented so as to define a plurality of spaced apart tail sound attenuating sections which are arranged in columns and rows, the columns of said tail sound attenuating sections being aligned with said columns of sound attenuating members, each of said tail sound attenuating sections in each column being substantially trapezoidal in cross-section, and progressively decreasing in size towards the exit end of the housing.

4. A sound silencer as recited in claim 2 wherein each of said nose and tail members is substantially filled with a sound absorptive material and each of said faces and sidewalls of said tail members and each planar end wall of said nose members is acoustically transparent.

5. A sound silencer as recited in claim 4 wherein each of said tail members is segmented so as to define a plurality of spaced apart tail sound attenuating sections which are arranged in columns and rows, the columns of said tail sound attenuating sections being aligned with said columns of sound attenuating members, each of said tail sound attenuating sections in each column being substantially trapezoidal in cross-section, and progressively decreasing in size towards the exit end of the housing.

6. A sound silencer as recited in claim 1 wherein said first pair of opposed faces of said sound attenuating members comprise a pair of opposed channel members and said second pair of opposed faces of said sound attenuating members comprise removable plate members.

7. A sound silencer as recited in claim 1 wherein said first pair of opposed faces of said sound attenuating members comprise a pair of opposed channel members while said second pair of opposed faces of said sound attenuating members are substantially open.

8. A sound silencer as recited in claim 1 wherein said first pair of opposed faces is acoustically transparent.

9. A sound silencer as recited in claim 8 wherein said first pair of opposed faces of said sound attenuating members comprise a pair of opposed channel members, and said second pair of opposed faces of said sound attenuating members comprise removable plate members.

10. A sound silencer as recited in claim 9 wherein said first pair of opposed faces of said sound attenuating members comprise a pair of opposed channel members while said second pair of opposed faces of said sound attenuating members are substantially open.

11. A sound silencer as recited in claim 1 wherein each of said sound attenuating members is substantially trapezoidal in cross-section having a first pair of opposed faces disposed at an angle to said first plurality of fluid passageways and a second pair of opposed faces disposed substantially perpendicular to said first plurality of fluid passageways.

12. A sound silencer as recited in claim 11 which further comprises:

a plurality of spaced apart nose members, each nose member being aligned with one of the columns of sound attenuating members and disposed substantially normal to the housing base, each of said nose members having a convex rounded end wall disposed directly adjacent the housing entry end portion and an opposed planar end wall disposed substantially parallel to said second plurality of fluid passageways; and a plurality of spaced apart tail members, each of said tail members being aligned with one column of sound attenuating members and disposed adjacent the housing exit end portion, each of said tail members including a pair of opposed end walls disposed substantially parallel to said second plurality of fluid passageways, and a pair of converging sidewalls disposed at an angle to said first plurality of fluid passageways.

13. A sound silencer for insertion in a duct having a fluid medium flowing therethrough comprising:

an outerhousing having an open entry end, an open exit end, a base portion, a roof portion, and a pair of opposed side walls; the main flow of the fluid medium being from the entry end of the housing to the exit end thereof;

a plurality of spaced apart sound attenuating members disposed within the housing, said sound attenuating members being arranged in columns and rows, each of said sound attenuating members being disposed substantially normal to said housing base and extending from said base to said housing roof such that said sound attenuating members define a first plurality of through passageways substantially parallel to the direction of the main flow of the fluid medium and extending from the entry end of the housing to the exit end thereof, and a second plurality of through passageways disposed substantially perpendicular to the direction of the main flow of the fluid medium and extending from one of said housing sidewalls to the other sidewall, each of said sound attenuating members being substantially filled with a sound absorptive material and being substantially rectangular in cross-section having a first pair of opposed faces disposed substantially parallel to said first plurality of through passageways and a second pair of opposed faces disposed substantially parallel to said second plurality of through passageways, each of said first and second pairs of faces of said sound attenuating faces being acoustically transparent;

a plurality of spaced apart nose members, each nose member being aligned with one of the columns of sound attenuating members and disposed substantially normal to the housing base, each of said nose members having a convex rounded end wall disposed directly adjacent the housing entry end portion and an opposed planar end wall disposed substantially parallel to said second plurality of through passageways; and a plurality of spaced apart tail members, each of said tail members being aligned with one column of sound attenuating members and disposed adjacent the housing exit end portion, each of said tail members including a pair of opposed end walls disposed substantially parallel to said second plurality of through passageways, and a pair of converging sidewalls disposed at an angle to said first plurality of through passageways.

14. A sound silencer as recited in claim 13 wherein each of said nose members and tail members is substantially filled with sound absorptive material and each of said end walls and sidewalls of said tail members and each planar end wall of said nose members are acoustically transparent.

15. A sound silencer as recited in claim 14 wherein each of said tail members is segmented so as to define a plurality of spaced apart tail sound attenuating sections which are arranged in columns and rows, the columns of said tail sound attenuating sections being aligned with said columns of sound attenuating members, each of said tail sound attenuating sections in each column being substantially trapezoidal in cross-section, and progressively decreasing in size towards the exit end of the housing.

* * * * *

UNITED STATES PATENT AND TRADEMARK OFFICE

CERTIFICATE OF CORRECTION

PATENT NO. : 4,316,522

DATED : February 23, 1982

INVENTOR(S) : Martin Hirschorn

It is certified that error appears in the above—identified patent and that said Letters Patent is hereby corrected as shown below:

Claim 1, line 3, change "outer-housing" to --outer housing--.

Claim 1, line 6, change "of" (secondary meaning) to --to--.

Claim 13, line 3, change "outerhousing" to --outer housing--.

Signed and Sealed this

First Day of June 1982

[SEAL]

*Attest:*

GERALD J. MOSSINGHOFF

*Attesting Officer*

*Commissioner of Patents and Trademarks*